US009850905B2

(12) United States Patent
Fournier et al.

(10) Patent No.: US 9,850,905 B2
(45) Date of Patent: Dec. 26, 2017

(54) COOLANT PUMP WITH PLASTIC BONDED MAGNET

(71) Applicant: PIERBURG PUMP TECHNOLOGY GMBH, Neuss (DE)

(72) Inventors: Arnaud Fournier, Yutz (FR); Jean-Christophe Schneider, Valmestroff (FR); Markus Schalong, Monheim (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 50 days.

(21) Appl. No.: 14/897,648

(22) PCT Filed: Jun. 14, 2013

(86) PCT No.: PCT/EP2013/062315

§ 371 (c)(1),
(2) Date: Dec. 11, 2015

(87) PCT Pub. No.: WO2014/198326

PCT Pub. Date: Dec. 18, 2014

(65) Prior Publication Data

US 2016/0115960 A1 Apr. 28, 2016

(51) Int. Cl.
*F04D 13/02* (2006.01)
*F01P 5/12* (2006.01)
(Continued)

(52) U.S. Cl.
CPC ..... *F04D 13/024* (2013.01); *F01P 5/12* (2013.01); *F01P 5/14* (2013.01); *F01P 7/162* (2013.01); *F04B 35/002* (2013.01); *F04D 15/02* (2013.01)

(58) Field of Classification Search
CPC . F04D 13/024; F04D 15/02; F01P 5/12; F01P 5/14; F01P 7/162; F04B 35/002
See application file for complete search history.

(56) References Cited

U.S. PATENT DOCUMENTS 4,419,644 A * 12/1983 Baermann ..... H01F 7/04 335/288
5,234,192 A * 8/1993 Kalippke ..... F02M 3/07 251/129.11

(Continued)

FOREIGN PATENT DOCUMENTS

CN 1126943 A 7/1996
CN 1217812 A 5/1999

(Continued)

*Primary Examiner* — Jacob Amick
(74) *Attorney, Agent, or Firm* — Norman B. Thot

(57) ABSTRACT

A coolant pump includes a pump frame, a driving wheel driven by an engine, a pump wheel driven by the driving wheel, and a clutch which couples the driving wheel with the pump wheel. The clutch comprises a friction surface arranged at the driving wheel, and a clutch disc which corresponds to the friction surface. The clutch disk is connected with and co-rotates with the pump wheel, and is axially shiftable between an engaged and a disengaged position. An axial pretension spring pretensions the clutch disc into the disengaged position. A permanent magnet forces the clutch disc into the engaged position. An electro-magnet, when energized, generates a polarization which is opposite to a polarization of the permanent magnet to reduce a total magnetic attraction force of the permanent magnet with respect to the clutch disc and to thereby push the clutch disc into the disengaged position via the pretension spring.

13 Claims, 3 Drawing Sheets

(51) Int. Cl.

| | |
|---|---|
| ***F01P 5/14*** | (2006.01) |
| ***F01P 7/16*** | (2006.01) |
| ***F04B 35/00*** | (2006.01) |
| ***F04D 15/02*** | (2006.01) |

(56) References Cited

U.S. PATENT DOCUMENTS

| | | | |
|---|---|---|---|
| 6,139,766 | A | 10/2000 | Taguchi et al. |
| 2010/0264758 | A1 | 10/2010 | Strohm et al. |

FOREIGN PATENT DOCUMENTS

| | | | | |
|---|---|---|---|---|
| CN | 102022175 | A | 4/2011 | |
| CN | 102568736 | A | 7/2012 | |
| DE | 26 38 944 | A1 | 3/1978 | |
| DE | 20 2008 013 303 | U1 | 3/2009 | |
| EP | 2 299 085 | A1 | 3/2011 | |
| EP | 2299085 | A1 * | 3/2011 | ..... F01P 5/12 |
| GB | 1 586 180 | A | 3/1981 | |
| JP | 57-25524 | A | 2/1982 | |
| JP | 58-16509 | A | 1/1983 | |
| JP | 7-259905 | A | 10/1995 | |
| JP | 10-270235 | A | 10/1998 | |
| JP | 2000-102201 | A1 | 4/2000 | |
| JP | 2001-246510 | A | 9/2001 | |

* cited by examiner

COOLANT PUMP WITH PLASTIC BONDED MAGNET

CROSS REFERENCE TO PRIOR APPLICATIONS

This application is a U.S. National Phase application under 35 U.S.C. §371 of International Application No. PCT/EP2013/062315, filed on Jun. 14, 2013. The International Application was published in English on Dec. 18, 2014 as WO 2014/198326 A1 under PCT Article 21(2).

FIELD

The present invention relates to a mechanical combustion engine coolant pump for pumping a coolant to an internal combustion engine.

BACKGROUND

A mechanical coolant pump is a coolant pump which is driven by a combustion engine, for example, by using a driving belt which drives a driving wheel of the pump. For efficiency reasons, only a minimum or even no coolant flow is needed as long as the temperature of the combustion engine is low or has not reached its operating range. Switchable mechanical coolant pumps are therefore used which are provided with a clutch to couple the driving wheel with the pump wheel pumping the coolant. The clutch is disengaged as long as the combustion engine is cold so that the circulation of the coolant is minimized or stopped, with the result that the warming of the combustion engine is sped up. The clutch is switched into the engaged position when coolant circulation is required.

A known type of clutch is the mechanical friction clutch which is actuated by the interaction of a pretensioning spring, a permanent magnet, and an electromagnet, as described in EP 2 299 085 A1. The permanent magnet causes a permanent magnetic attraction force which forces the clutch into the engaged position. When the electromagnet is energized, the magnetic force of the permanent magnet is reduced so that the clutch is forced by the spring into the disengaged position. The permanent magnet is a separate small ring with a high magnetic performance, for example, a permanent magnet made of sintered neodymium. These kinds of magnets, i.e., magnets of a rare-earth material, are expensive and difficult to machine. Ferromagnetic bodies are also necessary to conduct the magnetic field between the permanent magnet and the clutch discs.

SUMMARY

An aspect of the invention is to provide a combustion engine coolant pump with an electromechanically switchable friction clutch with a simple and cost-effective clutch arrangement.

In an embodiment, the present invention provides a combustion engine coolant pump for pumping a coolant to an internal combustion engine which includes a stationary pump frame, a driving wheel configured to be driven by the internal combustion engine, a pump wheel configured to be driven by the driving wheel, a switchable friction clutch configured to couple the driving wheel with the pump wheel, an axial pretension spring, a permanent magnet, and an electromagnet. The switchable friction clutch comprises a friction surface arranged at the driving wheel, and a shiftable clutch disc comprising a ferromagnetic material. The shiftable clutch disk corresponds to the friction surface. The shiftable clutch disk is connected with the pump wheel, is configured to co-rotate with the pump wheel, and is axially shiftable between an engaged position and a disengaged position. The axial pretension spring is configured to pretension the shiftable clutch disc into the disengaged position with a pretension force. The permanent magnet comprises a plastic bonded permanent magnet body comprising permanent magnetic particles embedded into a first plastic matrix material. The permanent magnet is configured to have a permanent magnet polarization and to cause an axial magnetic attraction force which forces the shiftable clutch disc towards the friction surface into the engaged position. The electromagnet is arranged in a magnetic circuit together with the permanent magnet. The electromagnet is configured, when energized, to generate an electromagnet polarization which is opposite to the permanent magnet polarization of the permanent magnet so as to reduce a total magnetic attraction force of the permanent magnet with respect to the shiftable clutch disc to thereby push the shiftable clutch disc into the disengaged position via the pretension spring.

BRIEF DESCRIPTION OF THE DRAWINGS

The present invention is described in greater detail below on the basis of embodiments and of the drawings in which.

DETAILED DESCRIPTION

Figure 1:
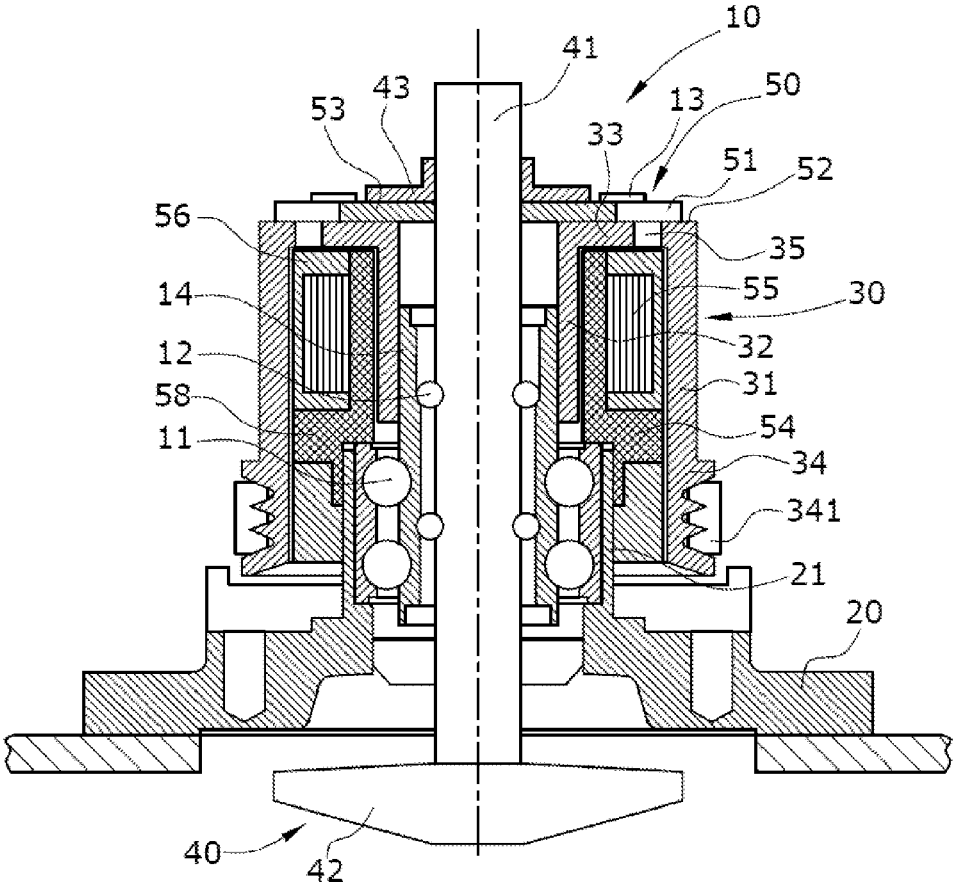
FIG. 1 shows a section of a first embodiment of a combustion engine coolant pump with a permanent magnet supporting an electromagnet.

The coolant pump is provided with a stationary pump frame, a driving wheel which is drivable by the combustion engine, a pump wheel which is drivable by the driving wheel, and a switchable friction clutch to couple the driving wheel with the pump wheel. The clutch comprises a shiftable clutch disc which is connected with the pump wheel, and a corresponding second clutch disc, or just a corresponding friction surface, which is arranged at the driving wheel opposite to the shiftable clutch disc. The shiftable clutch disc co-rotates with the pump wheel and is axially shiftable between an engaged position and a disengaged position of the clutch. In the engaged position, the shiftable clutch disc is forced towards the corresponding friction surface so that the rotation of the driving wheel is transmitted to the pump wheel. In the disengaged position, the shiftable clutch disc is not in contact with the corresponding friction surface. The shiftable clutch disc is made of a ferromagnetic material which enables the shiftable clutch disc to be shifted by a magnetic field.

An axial pretension spring pretensions the shiftable clutch disc towards or in direction of the disengaged position with a pretension force. The pretension spring co-rotates with the pump wheel and can, for example, be provided as a cup-like spring or a leaf-like spring. The cup-like spring does not necessarily have the shape of a closed ring, but can also be formed by two or more radial spring arms. The spring can also be a coil spring, an elastomer spring, or any other kind of spring.

A permanently magnetized permanent magnet causes an axial magnetic attraction force forcing the shiftable clutch disc towards the friction surface into the engaged position. An electromagnet is arranged in a magnetic circuit together with the permanent magnet. When the electromagnet is energized, the electromagnet is operated with a polarization generating a polarization opposite to the polarization of the permanent magnet. This results in a reduction or a compensation of the magnetic attraction force of the permanent magnet so that the shiftable clutch disc is forced or pushed into the disengaged position by the pretension force of the pretension spring. If the electromagnet is not energized or is switched-off, the shiftable clutch disc remains in or is shifted into the engaged position because the permanent magnet forces or pulls the shiftable clutch disc against the spring force of the pretension spring towards the corresponding friction surface.

The permanent magnet is a plastic bonded permanent magnet body with permanent magnetic particles, in particular magnet powder, embedded into a plastic matrix material, in particular into a thermoplastic matrix material. The two components, i.e., magnet powder and plastic matrix material, can, for example, be mixed, pressed, or processed in modified injection molding machines. Plastic bonded magnets are lightweight and freely shapeable. It is thus possible to mold or shape the permanent magnet into an individual and adapted form or shape which is especially adapted to the coolant pump assembly, to the location of the magnet, and/or to the physical conditions of operation. Since the relative heavy magnetic particles can furthermore be distributed homogenously or concentrated in the volume of the plastic body, the mass or weight, the center of mass, and/or the center of magnetic performance of the permanent magnet, can be individually created and adapted. The permanent magnet can thus be shaped individually with regard to the individual requirements. The permanent magnet can be completely encased or integrated in another component of the coolant pump. The permanent magnet can be fixed or mounted by gluing, pressing, or clipping on a body of a component of the coolant pump. The permanent magnet itself can furthermore be shaped or provided as another essential component of the coolant pump, such as the pump frame, while also being able to operate as a permanent magnet. An additional ferromagnetic body for conducting the magnetic force is generally not necessary, which saves weight and costs of the coolant pump.

In an embodiment of the present invention, the magnetic particles of the permanent magnet can, for example, be made of a hard ferrite material. Hard ferrite is a common type of magnetic material. The permanent magnet is able to provide a strong magnetic performance because the ferrite magnet particles are embedded into the plastic matrix material in a sufficient quantity.

In an embodiment of the present invention, the magnetic particles of the permanent magnet can, for example, be made of a rare earth magnetic material, such as neodymium. The permanent magnet can thus be shaped as a small component of the coolant pump while still being able to provide a sufficient magnetic performance to force the clutch disc into the engaged position. The magnetic particles of the permanent magnet can generally be a mixture of particles of a hard ferrite material and particles of a rare earth magnetic material, or a mixture of particles of any other magnetic material.

In an embodiment of the present invention, the permanent magnet can, for example, be a ring-like body or a cylindrical body with two open front ends. The permanent magnet can therefore be perfectly adapted with respect to an easy assembly to the coolant pump. The permanent magnet can generally be provided with any kind of shape, in particular a shape which corresponds to another component of the coolant pump, such as the component which is arranged adjacent or next to the permanent magnet, for example, the pump frame, the driving wheel, or any other component of the coolant pump.

In an embodiment of the present invention, the axial length of the permanent magnet can, for example, be at least ¼ of the axial length of the driving wheel. The permanent magnet can generally be completely or partially encased by any component of the coolant pump. The permanent magnet can, for example, be encased or housed by the driving wheel. The permanent magnet can, for example, also be a stationary part, and the driving wheel can, for example, be a rotating part so that a small gap is formed between the permanent magnet and the driving wheel. The mechanical gap is also a magnetic gap and can cause an increase in magnetic resistance with respect to the conduction of the magnetic field from the permanent magnet to the driving wheel. If the axial length of the permanent magnet is at least ¼ of the axial length of the driving wheel, a relatively large part of the total surfaces of the permanent magnet and of the driving wheel can be arranged to overlap, i.e., arranged adjacent to each other. As a consequence, the total magnetic resistance is relatively low so that the magnetic field generated by the permanent magnet can be conducted through the gap without a notable loss of magnetic force. Another ferrite component of the coolant pump, such as the pump frame, can generally be arranged between the permanent magnet and the driving wheel. The permanent magnet can furthermore support or encase one or more other component of the coolant pump, such as the electromagnet.

In an embodiment of the present invention, the permanent magnet can, for example, be fixed to the pump frame. The pump frame is stationary and can also be a pump housing. However, the permanent magnet can also be a part of a rotating component, such as the driving wheel. If the permanent magnet is fixed to the driving wheel, the number of magnetic gaps which weaken the engaging attraction force of the permanent magnet can be reduced to a minimum. The attraction force of the permanent magnet to engage the clutch is furthermore maximized if the permanent magnet is provided directly at the driving wheel and the driving wheel forms one of the two friction surfaces of the friction clutch. The permanent magnet fixed to the driving wheel is, however, exposed to vibration and heat, in particular heat generated by the friction clutch. Vibration, heat, or other negative effects of rotating components can cause deterioration or a decrease of the magnetic performance of the permanent magnet. The magnetic force of the permanent magnet which forces the shiftable clutch disc into the engaged position therefore decreases more and more. The magnetic force of the permanent magnet is ultimately lower than the pretension force of the pretension spring so that the shiftable clutch disc is switched or shifted into the disengaged position. A sufficient coolant circulation is therefore not provided and serious damage of the combustion engine can result. The clutch is also not fail safe. The permanent magnet can therefore, for example, be arranged to be stationary, for example, at the pump frame.

In an embodiment of the present invention, the permanent magnet can, for example, support, fix, and/or encase the electromagnet. The permanent magnet can also generally support other components of the coolant pump. The electromagnet can also generally be fixed directly to the stationary pump frame or to another component of the coolant pump. If the electromagnet is supported by the permanent magnet, the electromagnet can be encased by the permanent magnet completely or in part so that a relative large part of the surfaces of the electromagnet and of the permanent magnet are arranged adjacent to each other. The magnetic field generated by the electromagnet is thereby conducted to the permanent magnet via the relatively large part of the adjacently arranged surfaces so that the magnetic resistance is reduced to a minimum. It is thus sufficient to provide an electromagnet with a relatively low magnetic performance in order to completely compensate the magnetic force of the permanent magnet. The electromagnet can therefore have a relatively small size, thereby reducing the weight and size of the coolant pump.

In an embodiment of the present invention, the clutch can, for example, comprise a separate ferromagnetic body or back iron body which is made of a ferromagnetic material and which is able to conduct a magnetic field. The ferromagnetic body is in particular provided to conduct the magnetic field generated by the permanent magnet from the permanent magnet to the shiftable clutch disc in order to force the shiftable clutch disc into the engaged position. The ferromagnetic body can also be provided to conduct the magnetic field generated by the electromagnet to the permanent magnet.

In an embodiment of the present invention, the separate ferromagnetic body can, for example, be fixed to the stationary pump frame. The ferromagnetic body can also generally be a part of a rotating component, such as the driving wheel. Vibration and shocks can, however, cause micro-cracks in the ferromagnetic body which can result in deterioration or in a decrease of the magnetic conductibility of the ferromagnetic body. The conduction of the magnetic field of the permanent magnet is thereby deteriorated so that the shiftable clutch disc cannot be switched into or cannot remain in the engaged position. A sufficient coolant circulation is thus not provided. The ferromagnetic body can, for example, be arranged to be stationary.

In an embodiment of the present invention, the separate ferromagnetic body can, for example, support, fix, and/or encase the permanent magnet and/or the electromagnet. The electromagnet and/or the permanent magnet can be completely or partially encased by the separate ferromagnetic body. The separate ferromagnetic body can in turn be encased completely or partially by the stationary pump frame and/or the driving wheel. The size of the coolant pump can thus be reduced to a minimum. A large part of the surfaces of the electromagnet and/or of the permanent magnet and the ferromagnetic body can also be arranged to overlap, i.e., arranged adjacent to each other. The number of magnetic gaps which cause an increase in magnetic resistance can thus be reduced to a minimum. The magnetic field of the electromagnet and/or of the permanent magnet can thus be conducted to the ferromagnetic body via the relative large overlapping area of the surfaces.

In an embodiment of the present invention, the separate ferromagnetic body can, for example, be a plastic bonded ferrite body with ferromagnetic particles embedded into a plastic matrix material. Plastic bonded ferrite is lightweight and freely shapeable. It is thus possible to mold or shape the separate ferromagnetic body into an individual and adapted shape which is especially adapted to the coolant pump assembly, to the location of the ferromagnetic body, and to the physical requirements of operation of the ferromagnetic body. The separate ferromagnetic body can also be provided with the magnetic particles distributed homogenously or concentrated in the volume of the plastic body. The mass or weight, the center of mass, and/or the center of magnetic conductibility of the separate ferromagnetic body can thus be individually created and adapted. The ferromagnetic body can be fixed or mounted by gluing, pressing, or clipping on a body of a component of the coolant pump. The ferromagnetic body itself can alternatively be shaped as an component of the coolant pump, such as the pump frame, while also being able to conduct the magnetic field.

In an embodiment of the present invention, the axial length of the permanent magnet can, for example, be at least ½ of the axial length of the separate ferromagnetic body. The separate ferromagnetic body can, for example, encase, house, or be arranged adjacent to the permanent magnet. A relatively large part of the surfaces of the permanent magnet and of the ferromagnetic body can thus be arranged adjacent to each other. The magnetic field generated by the permanent magnet can thus be conducted to the ferromagnetic body via the relatively large part of the adjacently arranged surfaces so that the magnetic resistance is relatively low. It is thus sufficient to provide a permanent magnet with a relatively low magnetic performance. The permanent magnet is thus relatively inexpensive. The permanent magnet can also be designed to support or encase one or more components of the coolant pump, such as the electromagnet.

In an embodiment of the present invention, the electromagnet can, for example, be provided with a ring-like coil. The exciting coil can generally axially overlap the permanent magnet ring body. This configuration allows the electromagnetic field generated by the ring-like coil to effectively reduce or compensate the magnetic field generated by the permanent magnet.

In an embodiment of the present invention, the attraction force of the permanent magnet can, for example, be higher than the pretension force of the pretension spring if the electromagnet is not energized. If the shiftable clutch disc is in the disengaged position and the electromagnet is not energized, the effective attraction force of the permanent magnet is high enough to shift the shiftable clutch disc into the engaged position against the pretension force of the pretension spring. The failsafe position is thus the engaged position.

In an embodiment of the present invention, the radial gap between the driving wheel and the permanent magnet can, for example, be less than 1.0 mm. The permanent magnet can, for example, be a static part and the driving wheel can, for example, be a rotating part so that a mechanical gap is provided between these components of the coolant pump. The driving wheel can, for example, be made of a ferromagnetic material so that the magnetic field generated by the permanent magnet can be conducted to the shiftable clutch disc via the body of the driving wheel. The mechanical gap between the driving wheel and the permanent magnet is also a magnetic gap which weakens or deteriorates the magnetic field generated by the permanent magnet. If the mechanical gap is small, i.e., less than 1.0 mm, the magnetic gap can be reduced to a minimum so that the magnetic resistance is relatively low. It is thus sufficient to provide an inexpensive permanent magnet with a relatively low magnetic performance.

Three embodiments of the present invention are described below with reference to the drawings.

The FIG. 1 shows a longitudinal section of a switchable coolant pump 10 which is driven by an internal combustion engine (not shown) and which pumps a liquid coolant through the coolant channels of the combustion engine block (not shown). The following description refers to the longitudinal section view.

The coolant pump 10 is provided with a stationary pump frame 20, a rotatable driving wheel 30, and a pump wheel 40 supported by a rotating shaft 41. The driving wheel 30 comprises a co-rotating pulley 34 which is driven by a driving belt 341. A friction clutch 50 can be switched between an engaged position and a disengaged position by the interaction of a permanent magnet 54, of an electromagnet 55, and of a pretension spring 53. In the engaged position, the friction clutch 50 connects the driving wheel 30 with the pump wheel 40.

The driving wheel 30 is U-shaped in cross section, wherein the open side of the driving wheel 30 is orientated axially to the pump wheel 40. The radial outside leg 31 of the U-shaped driving wheel 30 is a cylinder which defines the cylindrical pulley 34. The radial inside leg 32 of the driving wheel 30 is a cylinder as well and is shrunk on a sleeve 14 which co-rotatably supports the driving wheel 30. The two driving wheel legs 31, 32 are connected by a radial ring-like connection plate 33. The driving wheel 30 is made in one piece and is made of a ferromagnetic material.

The connection plate 33 of the driving wheel 30 is provided with several openings 35 distributed circumferentially around the connection plate 33. The openings 35 are arranged correspondingly to the shiftable clutch disc 51, and are in particular arranged into the connection plate 33 in the area of the friction surface 52. The magnetic field conducted from the outside leg 31 to the inside leg 32 or vice versa is thus diverted via the remaining material of the connection plate 33, i.e., small bars. The magnetic field generated by the permanent magnet 54 causes a magnetic attraction force which pulls the shiftable clutch disc 51 towards the connection plate 33, in particular towards the corresponding friction surface 52. The friction clutch 50 is thus switched into in the engaged position so that the rotation of the driving wheel 30 is transmitted to the pump wheel 40. Once the shiftable clutch disc 51 is in contact with the connection plate 33 in the area of the opening 35, the shiftable clutch disc 51 is furthermore operated as a magnetic bridge so that the magnetic field generated by the permanent magnet 54 is conducted via the small bars of the connection plate 33 as well as via the shiftable clutch disc 51.

The sleeve 14 is supported by an outside ball bearing 11 and supports an inside ball bearing 12, the sleeve 14 is in particular the inner ring of the outside ball bearing 11 and is the outer ring of the inside ball bearing 12. The outside ball bearing 11 is supported by a cylinder portion 21 of the stationary pump frame 20. The inside ball bearing 12 supports the rotating shaft 41.

The pump wheel 40 is supported co-rotatably by the rotating shaft 41. The rotating shaft 41 is provided with a pump rotor 42 at the proximal end of the coolant pump 10, and with a hub body 43 at the distal end of the coolant pump 10. The rotating shaft 41 is rotatably supported by the inside ball bearing 12 which in turn is supported by the sleeve 14. The sleeve 14 is rotatably supported by the outside ball bearing 11 which in turn is supported by the stationary pump frame 20. The stationary pump frame 20 is provided with a flange to be fixable to the combustion engine block (not shown). The rotating shaft 41 is sealed against the stationary pump frame 20 by a shaft sealing.

The friction clutch 50 is arranged at the distal end of the coolant pump 10 and comprises an axially shiftable clutch disc 51 and a corresponding friction surface 52. A second friction clutch disc can be arranged as an alternative to the friction surface 52. The corresponding friction surface 52 is arranged opposite to the shiftable clutch disc 51, adjacent to the axial outside (distal) surface of the radial connection plate 33 which connects the two legs 31, 32 of the driving wheel 30. The shiftable clutch disc 51 is supported by the pretension spring 53 which is fixed to the hub body 43 at the rotating shaft 41. The shiftable clutch disc 51 is a friction ring body made of a ferromagnetic material which is elastically connected to the pretension spring 53 by three elastic connectors 13.

The pretension spring 53 axially pretensions the shiftable clutch disc 51 away from the corresponding friction surface 52 into the disengaged position of the friction clutch 50. The pretension spring 53 is formed by three radial spring arms which are arranged so that the radial outside end of the arms are in contact with the shiftable clutch disc 51 and the radial inside end of the arms are tangentially fixed to a supporting ring. The supporting ring is co-rotatably supported by the rotating shaft 41 and the hub body 43.

The permanent magnet 54 is arranged inside the ring-like space of the U-shaped driving wheel 30, and is in particular arranged radially between the two legs 31, 32. The permanent magnet 54 has the shape of a ring body which is axially magnetized. The permanent magnet 54 is supported by the cylinder portion 21 of the stationary pump frame 20 and is a non-rotating part. The magnetic field generated by the permanent magnet 54 is conducted to the driving wheel 30. For this purpose, the permanent magnet 54 is arranged so that three of the surfaces of the permanent magnet 54 are arranged adjacent to the surfaces of the driving wheel 30. The magnetic field is in particular conducted from the permanent magnet 54 to the driving wheel 30 via the radial inner side of the outside leg 31, via the radial outer side of the inside leg 32, and via the proximal side of the connection plate 33. A small gap is provided between the stationary permanent magnet 54 and the rotatably driving wheel 30 so that the permanent magnet 54 is not mechanically in contact with the driving wheel 30. The permanent magnet 54 supports an electromagnet 55 which is encased in part by a separate ferromagnetic body 56.

The ferromagnetic body 56 is arranged adjacent to the permanent magnet 54 and is also enclosed by the U-shaped driving wheel 30. The ferromagnetic body 56 is supported by the stationary pump frame 20 and is a non-rotating part. The ferromagnetic body 56 is formed to conduct the electromagnetic field generated by the electromagnet 55 along the permanent magnet 54 so that it causes a reduction or a compensation of the magnetic field and of the magnetic force generated by the permanent magnet 54.

The electromagnet 55 comprises a ring-like exciting coil. When the electromagnet 55 is energized, it generates a ring-like electromagnetic field with a constant polarization which is operated against the polarization of the magnetic field generated by the permanent magnet 54. As a result, the total magnetic force of the permanent magnet 54 is reduced to a level at which the axial force of the pretension spring 53 is higher than the total magnetic axial force of the permanent magnet 54. The shiftable clutch disc 51 is thus forced or shifted into the disengaged position. The shiftable clutch disc 51 remains in the disengaged position as long as the electromagnet 55 is energized. When the electromagnet 55 is not energized, the total axial magnetic force corresponds with the magnetic force of the permanent magnet 54. The magnetic force of the permanent magnet 54 is thus strong enough to pull the shiftable clutch disc 51 into the engaged position against the force of the pretension spring 53. If the electromagnet 55 fails, the shiftable clutch disc 51 thus engages and/or remains engaged so that the friction clutch 50 is fail safe.

Figure 2:
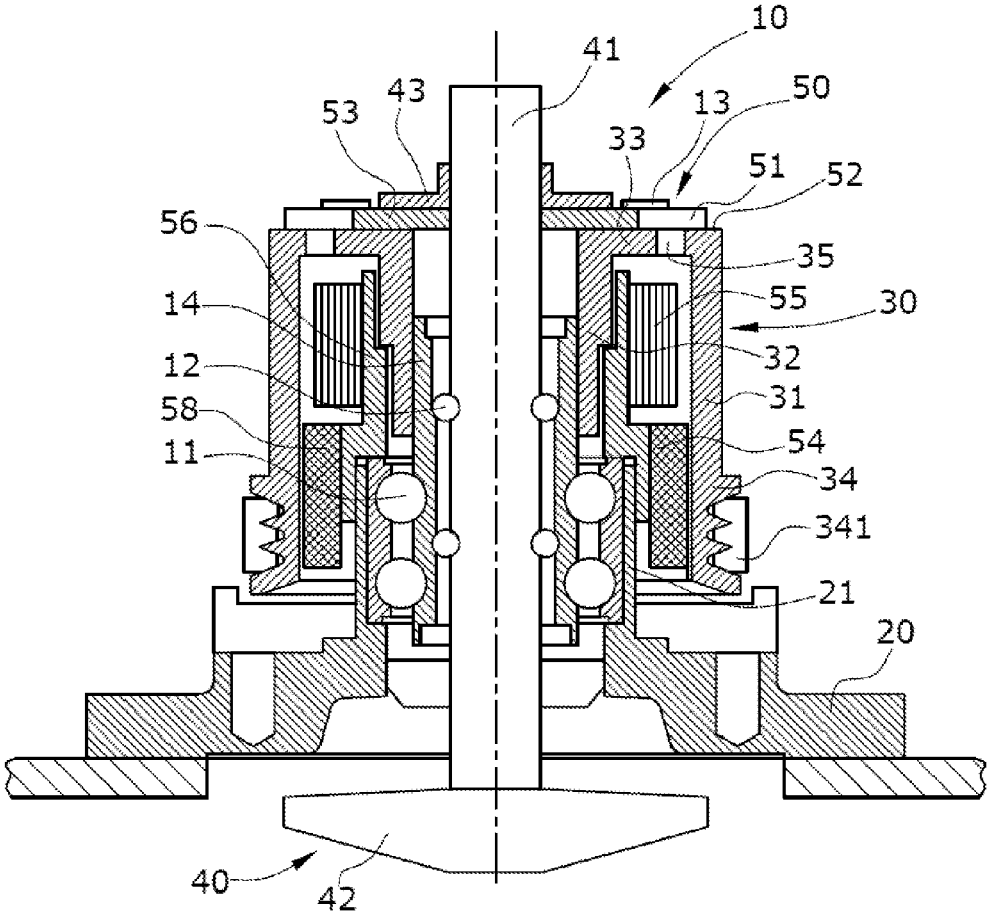
FIG. 2 shows a section of a second embodiment of a combustion engine coolant pump with a separate ferromagnetic body supporting a permanent magnet as well as an electromagnet.

FIG. 2 shows a longitudinal section of another embodiment of the switchable coolant pump 10.

The coolant pump 10 is provided with a stationary pump frame 20, a driving wheel 30, a pump wheel 40, and a clutch 50. The clutch 50 in FIG. 2 is provided with a permanent magnet 54 which is shaped as a sleeve-like body and is arranged next to the inner side of an outside leg 31 of the driving wheel 30. The permanent magnet 54 is axially magnetized and has an axial length of at least ⅔ of the axial length of a cylinder portion 21 of the stationary pump frame 20. The permanent magnet 54 thus comprises a relative large surface which is arranged adjacent to the driving wheel 30. The magnetic field of the permanent magnet 54 is thus conducted from the permanent magnet 54 to the driving wheel 30 via a relatively large area of the overlapping surfaces so that the magnetic resistance is relatively low. It is thus sufficient to provide the permanent magnet 54 with a relatively low magnetic performance.

The permanent magnet 54 is arranged at a location radially between the cylinder portion 21 of the stationary pump frame 20 and the outside leg 31 of the driving wheel 30. A radial gap is arranged between the stationary permanent magnet 54 and the driving wheel 30 so that the permanent magnet 54 is not in contact with the driving wheel 30. The permanent magnet 54 is supported by a separate ferromagnetic body 56 which in turn is supported by the cylinder portion 21 of the stationary pump frame 20. The ferromagnetic body 56 can be shrunk on the cylinder portion 21 of the stationary pump frame 20. The ferromagnetic body 56 furthermore supports an electromagnet 55 which is arranged next to the inner side of the outside leg 31 of the driving wheel 30, axially adjacent (distal) to the permanent magnet 54. The permanent magnet 54, the electromagnet 55, and the ferromagnetic body 56 are encased by the U-shaped driving wheel 30.

A coolant pump 10, as shown in FIG. 2, thus has a compact and slim design.

Figure 3:
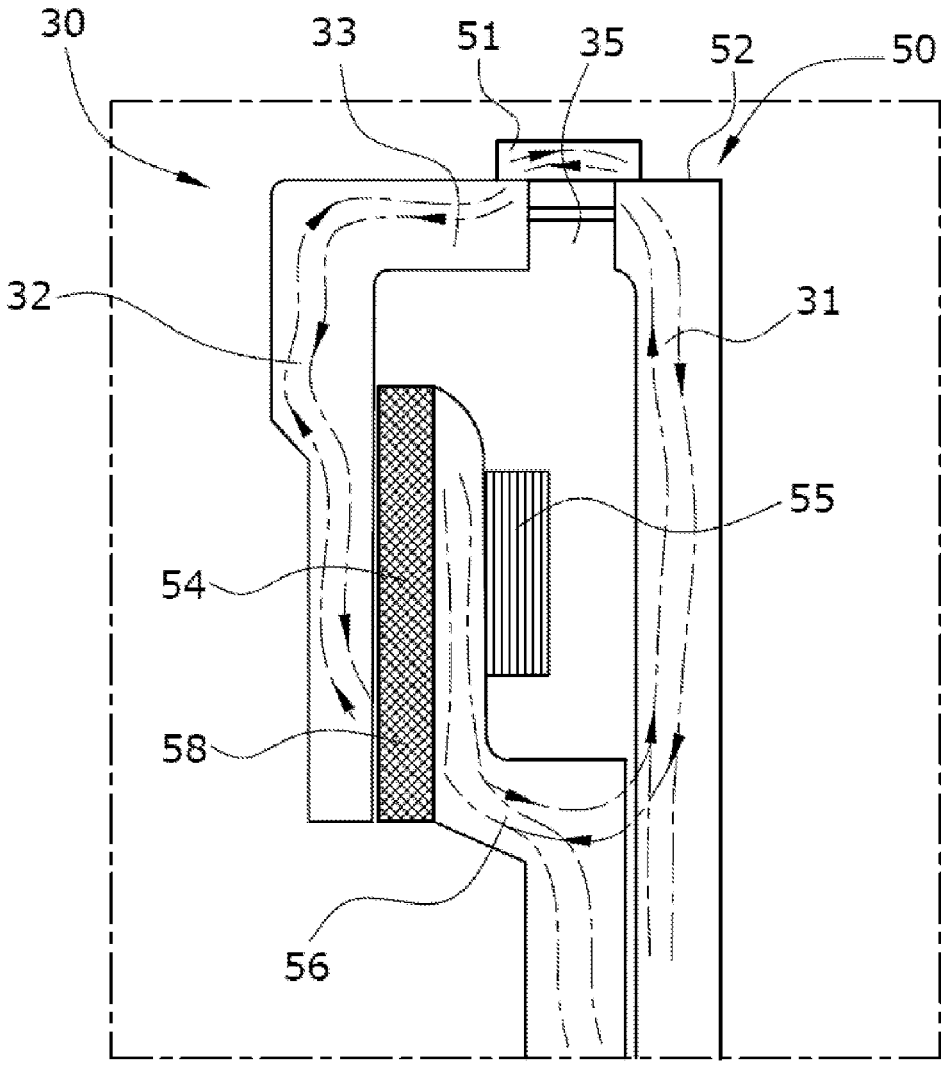
FIG. 3 shows the magnetic field lines in a section of a combustion engine coolant pump with a separate ferromagnetic body supporting a permanent magnet.

FIG. 3 shows the magnetic field lines visualized at a longitudinal section of the switchable coolant pump 10 which is similar to the coolant pump of FIG. 1.

FIG. 3 shows the coolant pump 10 with the clutch 50 being switched into the engaged position.

The coolant pump 10 is provided with a permanent magnet 54 which is shaped as a sleeve-like body. The permanent magnet 54 is arranged at a location radially between an inside leg 32 and an outside leg 31 of the driving wheel 30, and is in particular arranged next to the radial outer side of the inside leg 32 of the driving wheel 30. The permanent magnet 54 is provided with relatively large surface which is arranged adjacent to the driving wheel 30. The magnetic field generated by the permanent magnet 54 is thus conducted to the driving wheel 30 via the relative large area of the overlapping surfaces so that the magnetic resistance is relatively low.

A radial gap is arranged between the stationary permanent magnet 54 and the driving wheel 30 so that the permanent magnet 54 is not in contact with the driving wheel 30. The gap is small, e.g., smaller than 1.0 mm, so that the magnetic gap resistance is low. The magnetic field lines of the magnetic field generated by the permanent magnet 54 are shown in FIG. 3 as arrows in clockwise direction. If an electromagnet 55 is energized, it generates a ring-like electromagnetic field with a constant polarization which is operated against the polarization of the magnetic field generated by the permanent magnet 54. The magnetic field lines of the magnetic field generated by the electromagnet 55 are shown in FIG. 3 as arrows in anticlockwise direction.

The permanent magnet 54 is supported by a separate ferromagnetic body 56 which is also arranged radially between the inside leg 32 and the outside leg 31 of the driving wheel 30. The ferromagnetic body 56 can be supported by a pump frame (not shown in FIG. 3). The ferromagnetic body 56 furthermore supports the electromagnet 55 which is arranged next to the inner side of the outside leg 31. The permanent magnet 54, the electromagnet 55, and the ferromagnetic body 56 are encased by the U-shaped driving wheel 30.

The connection plate 33 of the driving wheel 30 is provided with axial openings 35 which are distributed circumferentially around the connection plate 33. Between the openings 35, remaining material of the connection plate 33, i.e., small bars, is arranged. The shiftable clutch disc 51 which is switched into the engaged position is pulled towards the connection plate 33, in particular towards the corresponding friction surface 52, by the magnetic field of the permanent magnet 54. The shiftable clutch disc 51 is thus operated as a magnetic bridge so that the magnetic field of the permanent magnet 54 is conducted from the inside leg 32 to the outside leg 31 via the small bars between the inside leg 32 and the outside leg 31 as well as via the shiftable clutch disc 51. The shiftable clutch disc 51 is thus forced into the engaged position by the magnetic attraction force.

The present invention is not limited to embodiments described herein; reference should be had to the appended claims.

REFERENCE NUMERALS

10 coolant pump
11 outside ball bearing
12 inside ball bearing
13 elastic connectors
14 sleeve
20 stationary pump frame
21 cylinder portion
30 driving wheel
31 outside leg
32 inside leg
33 connection plate
34 pulley
341 driving belt
35 opening
40 pump wheel
41 rotating shaft
42 pump rotor
43 hub body
50 clutch
51 shiftable clutch disc
52 friction surface
53 pretension spring
54 permanent magnet
55 electromagnet
56 ferromagnetic body
58 plastic bonded permanent magnet body

What is claimed is:

1. A combustion engine coolant pump for pumping a coolant to an internal combustion engine, the combustion engine coolant pump comprising:

a stationary pump frame;

a driving wheel configured to be driven by the internal combustion engine;

a pump wheel configured to be driven by the driving wheel;

a switchable friction clutch configured to couple the driving wheel with the pump wheel, the switchable friction clutch comprising, a friction surface arranged at the driving wheel, only one separate ferromagnetic body, and a shiftable clutch disc comprising a ferromagnetic material, the shiftable clutch disk corresponding to the friction surface, and being, connected with the pump wheel, configured to co-rotate with the pump wheel, and axially shiftable between an engaged position and a disengaged position;

an axial pretension spring configured to pretension the shiftable clutch disc into the disengaged position with a pretension force;

a permanent magnet comprising a plastic bonded permanent magnet body comprising permanent magnetic particles embedded into a first plastic matrix material, the permanent magnet being configured to have a permanent magnet polarization and to cause an axial magnetic attraction force which forces the shiftable clutch disc towards the friction surface into the engaged position; and an electromagnet arranged in a magnetic circuit together with the permanent magnet, the electromagnet being configured, when energized, to generate an electromagnet polarization which is opposite to the permanent magnet polarization of the permanent magnet so as to reduce a total magnetic attraction force of the permanent magnet with respect to the shiftable clutch disc to thereby push the shiftable clutch disc into the disengaged position via the pretension spring, wherein, the only one separate ferromagnetic body of the switchable friction clutch is configured to directly support each of the permanent magnet and the electromagnet.

2. The combustion engine coolant pump as recited in claim 1, wherein the permanent magnetic particles of the permanent magnet are made of a hard ferrite.

3. The combustion engine coolant pump as recited in claim 1, wherein the permanent magnetic particles of the permanent magnet are made of a rare earth element.

4. The combustion engine coolant pump as recited in claim 1, wherein the permanent magnet is provided as a ring-shaped body.

5. The combustion engine coolant pump as recited in claim 1, wherein, the permanent magnet comprises a permanent magnet axial length, the driving wheel comprises a driving wheel axial length, and the permanent magnet axial length is at least ¼ of the driving wheel axial length.

6. The combustion engine coolant pump as recited in claim 1, wherein the permanent magnet is fixed to the stationary pump frame.

7. The combustion engine coolant pump as recited in claim 1, wherein the permanent magnet is configured to support the electromagnet.

8. The combustion engine coolant pump as recited in claim 1, wherein the separate ferromagnetic body is fixed to the stationary pump frame.

9. The combustion engine coolant pump as recited in claim 1, wherein the separate ferromagnetic body is a plastic bonded ferrite body comprising ferromagnetic particles embedded into a second plastic matrix material.

10. The combustion engine coolant pump as recited in claim 1, wherein, the permanent magnet comprises a permanent magnet axial length, the separate ferromagnetic body comprises a separate ferromagnetic body axial length, and the permanent magnet axial length is at least ½ of the separate ferromagnetic body axial length.

11. The combustion engine coolant pump as recited in claim 1, wherein the electromagnet comprises a coil configured to be ring-like.

12. The combustion engine coolant pump as recited in claim 1, wherein the axial magnetic attraction force of the permanent magnet is greater than the pretension force of the pretension spring when the electromagnet is not energized.

13. The combustion engine coolant pump as recited in claim 1, wherein a radial gap between the driving wheel and the permanent magnet is less than 1.0 mm.

* * * * *